United States Patent [19]

Bugge

[11] Patent Number: 4,729,412

[45] Date of Patent: Mar. 8, 1988

[54] FORMING FABRIC OF DOUBLE-LAYER TYPE

[75] Inventor: Hans J. Bugge, Halmstad, Sweden

[73] Assignee: Nordiskafilt AB, Halmstad, Sweden

[21] Appl. No.: 879,360

[22] Filed: Aug. 11, 1986

Related U.S. Application Data

[63] Continuation-in-part of Ser. No. 579,811, Feb. 13, 1984, Pat. No. 4,611,639.

[30] Foreign Application Priority Data

Feb. 23, 1983 [SE] Sweden ..... 8300984

[51] Int. Cl.[4] ..... D03D 11/00; D03D 25/00

[52] U.S. Cl. ..... 139/383 A; 139/413; 139/410

[58] Field of Search ..... 139/383 A, 425 A, 408, 139/409, 410, 411, 412, 413

[56] References Cited

U.S. PATENT DOCUMENTS

| | | | |
|---|---|---|---|
| 2,797,713 | 7/1957 | Hoffacker | 139/411 |
| 2,936,796 | 5/1960 | Hindle et al. | 139/383 A X |
| 2,947,328 | 8/1960 | Asten et al. | 139/383 A X |
| 2,949,134 | 8/1960 | Hindle et al. | 139/383 A X |
| 3,885,603 | 5/1975 | Slaughter | 139/425 A |

FOREIGN PATENT DOCUMENTS

| | | | |
|---|---|---|---|
| 69101 | 1/1983 | European Pat. Off. | 139/383 A |

*Primary Examiner*—Stephen Marcus
*Assistant Examiner*—T. Graveline
*Attorney, Agent, or Firm*—Kane, Dalsimer, Sullivan, Kurucz, Levy, Eisele and Richard

[57] ABSTRACT

A forming fabric for use e.g. in the papermaking industry. The fabric comprises a first weave (1) including weft threads (4) and warp threads (3), and a second weave (2) which is interconnected with the first weave, said second weave comprising coarser weft threads (6), which interweave with warp threads (5) arranged in groups of at least two threads. The warp threads (5) of each group run in parallel with each other and weave alike with the weft threads (6) of the second weave (2).

1 Claim, 9 Drawing Figures

FORMING FABRIC OF DOUBLE-LAYER TYPE

The present invention is a continuation-in-part of U.S. application No. 579,811 filed Feb. 13, 1984 now U.S. Pat. No. 4,611,639.

FIELD OF THE INVENTION

The subject invention concerns a forming fabric for use in papermaking, cellulose and similar machines. The forming fabric is of the type comprising a first system of warp threads and a first system of weft threads which are woven into a first weave which in position of use of the fabric faces the material to be formed, and a second system of warp threads and a second system of weft threads which are woven into a second weave which in position of use of the fabric faces the dewatering members of the machine, said first and second weaves being joined together to form a double weave.

BACKGROUND OF THE INVENTION

In the production of paper in a papermaking machine a slurry of fibers suspended in a water is discharged onto a wire of a mesh-like construction. The water is drained off from the fiber slurry through the openings formed in the wire. The fibers are formed into a paper sheet on the upper surface of the cloth. Since the water through-flow takes place at the points where the thread material of the cloth does not prevent water drainage it is of the greatest importance that these through-flow points are evenly distributed across the entire surface of the cloth. The permeability of the forming fabric must be of a certain magnitude while at the same time the fabric surface must be a very fine-mesh weave in order to prevent marking on the paper sheet and fiber losses. However, fine-mesh cloths made from thin threads have reduced resistance to wear and abrasion and possess impaired stability and as a result their serviceable life is highly shortened. Up to the beginning of the 1960s only single-layer fabrics or wires of metal were used for the formation of paper sheets. To some extent the metal wire were replaced by single-layer fabrics of synthetic fiber threads, known as plastic cloths, which although being more resistant to wear and abrasion were also less stable than the metal ones. On account of their poor stability single-layer plastic cloths cannot be used in large high-speed papermaking machines. Not until the advent of the double-layer forming fabrics as they are called could synthetic fiber materials be utilized to any noticeable extent in these large high-speed machines. In this type of machine the forming fabric is exposed to considerable tensile stress which the fabric has to be able to take without stretching lengthwise or contracting crosswise to such an extent than the fabric loses its ability to serve its intended purpose. By the expression "double-layer forming fabric" is for the purposes herein to be understood forming fabrics consisting of two layers of synthetic weft threads and of synthetic warp threads interconnecting said two weft thread layers.

The next step of development concerned a forming fabric comprising two complete interwoven weaves, each one having its individual set of warp threads and weft threads. The part of fabric closest to the material to be formed as a rule consists of fine threads forming a fine-mesh construction whereas the bottom weave consists of a coarser and more wear-resistant threads forming a coarser-mesh construction.

The double-layer forming fabric comprising two layers of weft threads and the double weave comprising two complete weaves have proved to be supplementary. The first type of fabric is preferably used in the majority of large papermaking machines whereas the last-mentioned fabric is most suitable for use in positions where the demands on the quality and properties of the paper surface are extremely strict, such as is the case as regards high-quality paper and magazine paper. However, from a technical and practical point of view it is a serious drawback to have to use two different systems of warps and in addition each system of this kind must differ as regards the dimensions of the warp threads used and the density of the warp threads.

This drawback has been removed through the subject invention which is characterized in that the warp threads of the second system of warp threads which in position of use of the fabric faces the dewatering elements of the machine are arranged in groups comprising at least two adjacent warp threads, which two threads weave in an identical manner and in essentially parallel with each other when weaving with the weft threads of the second system of weft threads.

The arrangement in accordance with the subject invention makes it possible to produce double-layer type of fabrics as well as double-weave types of fabrics, using the same warp having equal thread dimensions and thread densities. For instance, a warp comprising threads of a dimension of 0.22 mm may be set up in a reed with a thread density of 52 threads per cm. Initially is woven a double-layer forming fabric in which all warp threads are used to interconnect the two layers of weft thread. The warp fill factor, that is, the area of the fabric surface which theoretically is covered by warp threads, in this case is $0.20 \times 5.2 = 1.04$, which is completely normal in these types of weaves. While retaining the same warp set-up it is then possible to weave a double-weave construction. Half the number of the warp threads, that is 26 per cm, are in this case used to interweave with a first system of weft threads so as to form a first weave which in position of use of the final fabric faces the material to be formed. The warp fill factor for this weave is $0.20 \times 2.6 = 0.52$, which is likewise normal in the case of single-layer constructions. The other half of the warp threads are used to interweave with a second system of weft threads so as to form a second weave which in position of use of the final fabric faces the dewatering elements of the machine. To achieve this, the warp threads are arranged in groups comprising two threads each, which two threads weave in an identical manner and in essentially parallel with each other when weaving with the weft threads of the second system of weft threads. These double warp threads, which thus are 13 double or paired threads per centimeter, replace the coarser type of warp threads which have hitherto been used, the number of these coarser threads usually being half that of the threads of the first weave.

In addition to providing the technical and practical advantages outlined above the structure in accordance with the teachings of the subject invention also provides the same advantages as those found in thinner fabrics as compared with corresponding forming fabrics comprising coarser threads in the bottom warp. It has been found that the forming fabric in accordance with the subject invention is also more stable than the prior-art fabrics.

The invention will be described in closer detail in the following with reference to the accompanying schematical drawings, wherein.

Figure 1:
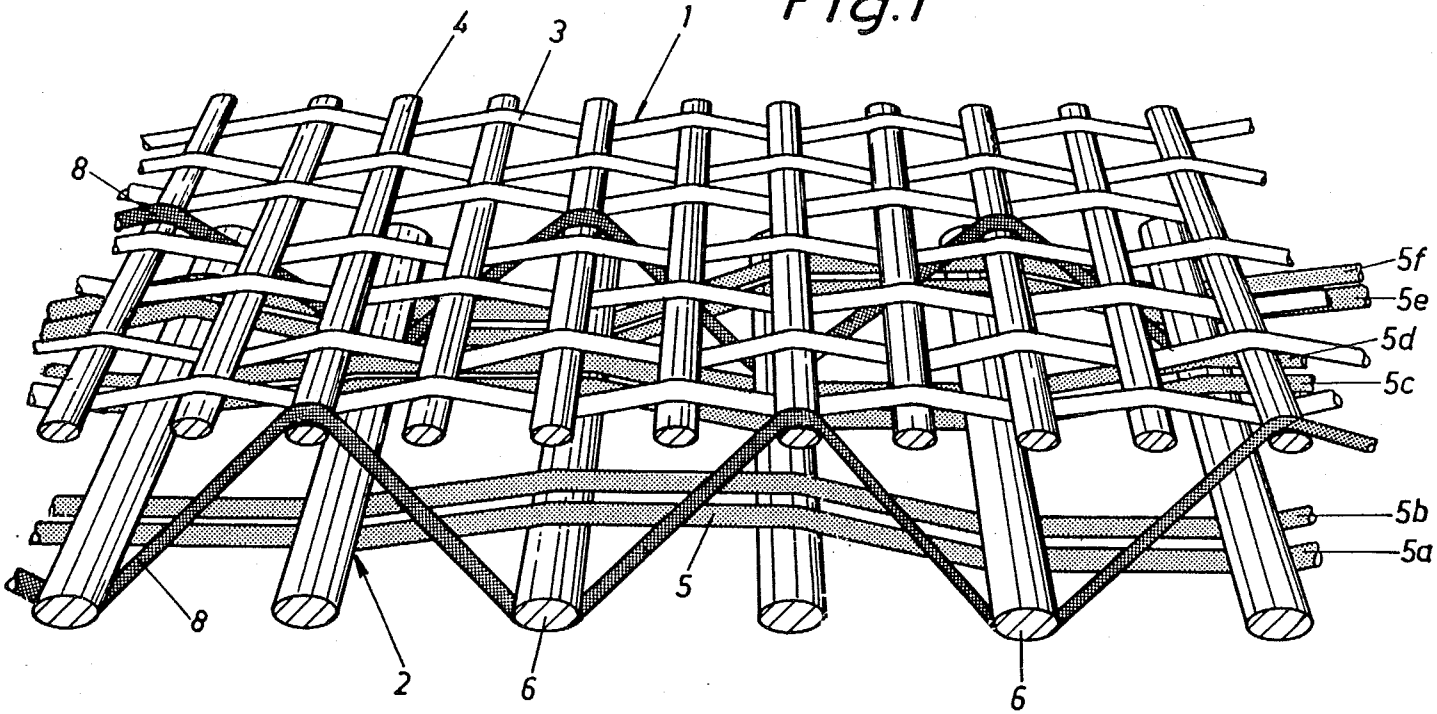
FIGS. 1–2 are perspective views of the fabric of the subject invention in accordance with two embodiments thereof.

FIG. 1 shows a part of a fabric constructed in accordance with the teachings of the subject invention, the threads forming the fabric having been pulled apart in order to show the weave patterns of the threads. The fabric comprises a first top weave 1 which in position of use the fabric faces the material to be formed, and a second bottom weave 2 which in position of use of the fabric faces the dewatering elements of the papermaking machine. The top weave 1 comprises one system of the warp threads 3 which are interwoven with a system of weft threads 4. In accordance with the embodiment shown in the drawing the warp threads 3 and the weft threads 4 are interwoven in a two-shaft weave pattern. The bottom weave 2 comprises one system of warp threads 5 and one system of weft threads 6 which are interwoven in a four-shaft Batavia weave pattern. The top weave 1 and the bottom weave 2 are joined together by a binder warp thread 8 which weaves with the weft threads 4 of the top weave 1 as well as with the weft threads 6 of the bottom weave 2. The warp threads 5 of the bottom weave illustrate the inventive idea of the subject invention in that they are arranged in groups, *5a–b*, *5c–d*, *5e–f*, each group comprising two threads which weave alike and in parallel with each other.

Figure 2:
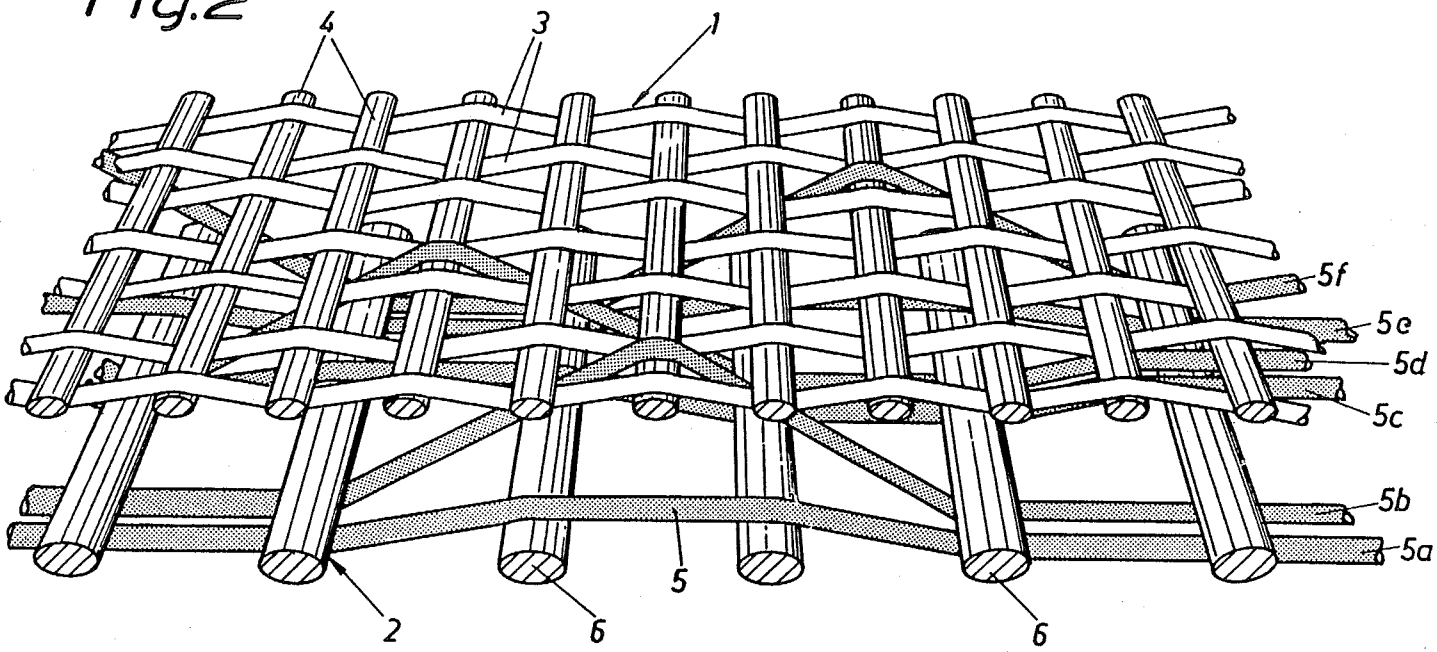

FIG. 2 shows top weave 1 and bottom weave 2 interwoven similar what is shown in FIG. 1. The top weave 1 and the bottom weave 2 are joined together by certain threads 4 of the first system interlace with threads 5 of the second system. Specific one of the threads *5b*, *5d*, *5f*, of each of the groups *5a–b*, *5c–d* and *5e–f* interweave with certain threads 4. The idea of the subject invention remains in that each group of threads 5 weave alike and essentially in parallel with each other when weaving in repeating pattern with weft threads 6 of the second system of weft threads.

Figure 3:
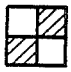
FIGS. 3–7 show various examples of binding or weave-patterns of the various weave layers of the double weave.
Figure 4:
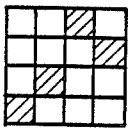

The two weaves 1,2 may be designed in a large variety of different weave patterns. FIGS. 3 and 4 show two examples of the design of the top weave. FIG. 3 shows a two-shaft weave pattern, the vertical rows illustrating warp threads and the horizontal ones weft threads. Shaded squares indicate that the warp threads weave above the weft threads. In an identical manner, FIG. 4 shows a four-shaft X-twill weave pattern.

Figure 5:
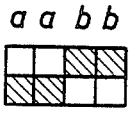
Figure 6:
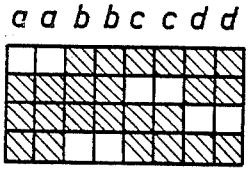
Figure 7:
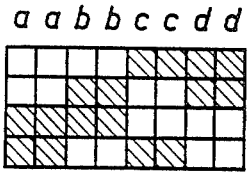

Also the bottom weave may be designed in many different binding weave patterns, FIGS. 5–7 showing some examples thereof. FIG. 5 shows a weave design which is derived from a two-shaft weave pattern. The weave pattern shown in FIG. 6 is derived from a four-shaft X-twill weave pattern whereas the weave pattern in accordance with FIG. 7 is derived from a four-shaft X-twill Batavia weave pattern. One feature that all the weave patterns exemplified in FIGS. 5–7 have in common is that the warp threads are arranged in groups of two which weave in an identical manner and in parallel with each other. For instance, the two warp threads a in the drawing figures illustrated weave in an identical manner, which also is true of the threads b, c, and d.

Figure 8:
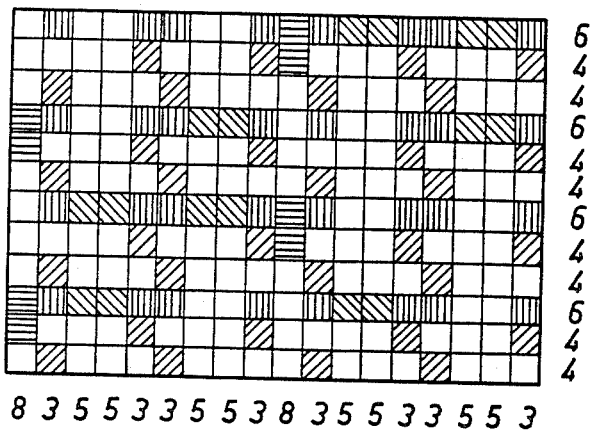
FIGS. 8–9 illustrate the binding of weave pattern of the interwoven double-weave of the embodiments of the fabric shown in FIGS. 1 and 2 respectively.
Figure 9:
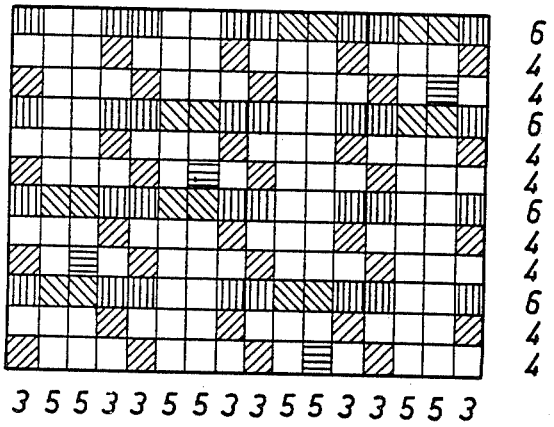

A top weave may then be interwoven with a bottom weave into a double-weave. In FIG. 8 and 9 are illustrated two embodiments including a top weave woven in accordance with the weave pattern shown in FIG. 3 and a bottom weave woven according to the weave pattern shown in FIG. 7. These two weaves are woven together, using the weave pattern shown in FIG. 8 and 9. In the warp direction (vertical) are shown the warp threads 3 of the top weave and the warp threads 5 of the bottom weave and in the weft direction (horizontal) are shown the warp threads 4 of the top weave and the weft threads 6 of the bottom weave. In FIG. 8 warp binder threads 8 interconnect the two weaves. In FIG. 9 one of the two adjacent threads 5 of each group of thread 5 interlacing with threads 4 of the top layer 1. The weave pattern is characterized in that the warp threads 5 are arranged in groups of two adjacent threads interweaving each such group of threads in an identical manner and essentially in parallel with each other, when weaving with the weft threads 6 from the second system of weft threads.

The invention is not limited to the embodiments described in the aforegoing and illustrated in the drawings but a number of modifications are possible within the scope of the appended claims. For instance, the weave or binding patterns of both the top and bottom weaves may be varied in many other ways than those shown by way of example. Except by using separate binder warp thread the interconnection of the two weaves may be affected also by using separate binder weft thread. Besides embodiment illustrated it is also possible to interlace top warp threads with bottom weft threads. One or several of the warp threads weaving identically and in parallel within the same group in the bottom system of warp threads may be used to interlace with separate weft binder threads. An individual group of warp threads of the bottom system of warp threads is not either limited to comprising two threads as shown in the embodiments described and illustrated herein.

What is claimed is:

1. An improved open mesh fabric for use in forming a fiber web in papermaking, cellulose and similar machines, said fabric comprising:

a first system of warp threads and a first system of weft threads, all warp threads of said first system of warp threads weaving with the first system of weft threads in a repeating pattern to form a first complete weave which during position of use of said fabric faces said fiber web to be formed thereon;

a second system of warp threads and a second system of weft threads, said two second systems of threads interwoven to form a second complete weave;

warp threads of said second system of warp threads being arrange in groups, each such group comprising at least two adjacent warp threads interweaving essentially in side by side relation parallel with each other and in a repeating pattern with weft threads of said second system of weft threads; and said first complete weave and said second complete weave being joined together to form a double weave where at least one of the adjacent warp threads, interweaving essentially is side by side relation, parallel with each other, interlaces with weft threads of the first system of weft threads.

* * * * *